US008401441B2

(12) United States Patent
Uneme et al.

(10) Patent No.: US 8,401,441 B2
(45) Date of Patent: Mar. 19, 2013

(54) CARTRIDGE AND ELECTROPHOTOGRAPHIC IMAGE FORMING APPARATUS

(75) Inventors: Tetsushi Uneme, Susono (JP); Takahito Ueno, Mishima (JP); Yuuki Nakamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/591,543

(22) Filed: Aug. 22, 2012

(65) Prior Publication Data

US 2012/0315062 A1 Dec. 13, 2012

Related U.S. Application Data

(62) Division of application No. 12/547,992, filed on Aug. 26, 2009, now Pat. No. 8,275,283.

(30) Foreign Application Priority Data

Sep. 1, 2008 (JP) ..... 2008-223044
Aug. 4, 2009 (JP) ..... 2009-181143

(51) Int. Cl.
*G03G 15/08* (2006.01)

(52) U.S. Cl. ..... 399/274; 399/264; 399/284

(58) Field of Classification Search ..... 399/264, 399/274, 284
See application file for complete search history.

(56) References Cited

U.S. PATENT DOCUMENTS 4,537,491 A 8/1985 Komada et al.
5,758,231 A * 5/1998 Coffey et al. ..... 399/106
5,758,233 A 5/1998 Coffey et al.
5,761,589 A 6/1998 Kido et al.
5,768,661 A 6/1998 Coffey et al.
6,078,770 A * 6/2000 Watabe et al. ..... 399/284
6,181,904 B1 1/2001 Burdette et al.
6,208,817 B1 3/2001 Chadani et al.
6,385,416 B1 5/2002 Horikawa et al.
6,483,034 B1 11/2002 Sasagawa et al.
6,608,980 B2 8/2003 Murayama et al.
6,714,752 B2 3/2004 Ueno et al.
6,823,153 B2 11/2004 Ueno et al.
6,829,455 B2 12/2004 Yasumoto et al.
6,834,175 B2 12/2004 Murayama et al.
6,898,391 B2 5/2005 Numagami et al.
6,912,365 B2 6/2005 Ueno et al.
6,954,600 B2 10/2005 Fujita et al.
6,954,601 B2 10/2005 Numagami et al.
6,968,146 B1 11/2005 Fujita et al.
6,970,668 B2 11/2005 Ueno et al.
6,978,099 B2 12/2005 Ueno et al.
7,003,247 B2 2/2006 Koishi et al.
7,062,200 B2 6/2006 Ueno et al.
(Continued)

FOREIGN PATENT DOCUMENTS

JP 5-173412 7/1993
JP 2000-131927 5/2000
(Continued)

*Primary Examiner* — David Gray
*Assistant Examiner* — G. M. Hyder
(74) *Attorney, Agent, or Firm* — Fitzpatrick, Cella, Harper & Scinto

(57) ABSTRACT

A cartridge detachably mountable to a main assembly of an electrophotographic image forming apparatus includes a developer carrying member for developing an electrostatic latent image formed on an image bearing member, and an electroconductive developer layer thickness regulating member for regulating a layer thickness of a developer deposited on the developer carrying member. A part of the developer layer thickness regulating member is directly contactable to the main assembly electrical contact.

10 Claims, 12 Drawing Sheets

U.S. PATENT DOCUMENTS

| | | | |
|---|---|---|---|
| 7,092,658 | B2 | 8/2006 | Yasumoto et al. |
| 7,139,502 | B2 | 11/2006 | Koishi et al. |
| 7,158,749 | B2 | 1/2007 | Ueno et al. |
| 7,164,875 | B2 | 1/2007 | Miyabe et al. |
| 7,174,122 | B2 | 2/2007 | Fujita et al. |
| 7,184,690 | B2 | 2/2007 | Ueno et al. |
| 7,209,682 | B2 | 4/2007 | Numagami et al. |
| 7,248,810 | B2 | 7/2007 | Miyabe et al. |
| 7,315,710 | B2 | 1/2008 | Ueno et al. |
| 7,366,452 | B2 | 4/2008 | Fujita et al. |
| 7,440,715 | B2 | 10/2008 | Numagami et al. |
| 7,450,877 | B2 | 11/2008 | Miyabe et al. |
| 7,457,566 | B2 | 11/2008 | Koishi et al. |
| 7,483,646 | B2 | 1/2009 | Ueno et al. |
| 2006/0269318 | A1 | 11/2006 | Ueno et al. |
| 2008/0152388 | A1 | 6/2008 | Ueno et al. |
| 2008/0260428 | A1 | 10/2008 | Ueno et al. |
| 2008/0286000 | A1 | 11/2008 | Kimizuka et al. |
| 2008/0292331 | A1 | 11/2008 | Yokomori et al. |
| 2009/0047037 | A1 | 2/2009 | Miyabe et al. |
| 2009/0092411 | A1 | 4/2009 | Ueno et al. |
| 2009/0226206 | A1 | 9/2009 | Ueno et al. |

FOREIGN PATENT DOCUMENTS

| | | |
|---|---|---|
| JP | 2000-214659 | 8/2000 |
| JP | 2004-117806 | 4/2004 |

* cited by examiner (a)

(b)

CARTRIDGE AND ELECTROPHOTOGRAPHIC IMAGE FORMING APPARATUS

FIELD OF THE INVENTION AND RELATED ART

The present invention relates to a cartridge and an electrophotographic image forming apparatus to which the cartridge is detachably mountable.

In a conventional electrophotographic image forming apparatus, an electrostatic latent image formed on an electrophotographic portion is developed by a developing means including a developing roller and a developing blade to be visualized as a toner image. In such an image forming apparatus, a constitution in which the developing means including the developing roller and the developing blade is prepared by integrally supporting the roller and the blade into a cartridge and the resultant developing cartridge is detachably mountable to a main assembly of the image forming apparatus has been known.

In order to develop the electrostatic latent image formed on the photosensitive drum by depositing toner on the electrostatic latent image, it is necessary to apply a bias voltage to the developing means. For this purpose, the developing cartridge and the main assembly of the electrophotographic image forming apparatus are electrically connected to each other and a voltage is supplied from the main assembly to the developing cartridge.

A constitution for supplying the voltage from the main assembly of the electrophotographic image forming apparatus to the developing cartridge will be described. The developing cartridge is provided with input electrical contacts connected to respective constituent members such as the developing roller and the developing blade. The main assembly is provided with main assembly electrical contacts which contacts the respective input electrical contacts provided to the developing cartridge when the developing cartridge is mounted to the main assembly. By the contact of the input electrical contacts, connected to the respective constituent members, with the main assembly electrical contacts of the main assembly, it is possible to supply a voltage from the main assembly to the developing cartridge (Japanese Laid-Open Patent Application No. 2004-117806).

In this case, the voltage supply from the main assembly to the developing cartridge is enabled by providing to the developing cartridge an electrical contact member connected to both of the input electrical contacts, connected to the respective constituent members such as the developing roller and the developing blade constituting the developing cartridge, and the main assembly electrical contacts of the main assembly.

However, in recent years, the developing cartridge has been required to realize further simplification, further cost reduction, and further space saving.

SUMMARY OF THE INVENTION

A principal object of the present invention is to simplify a constitution for electrically connecting a main assembly of an electrophotographic image forming apparatus to a cartridge by reducing the number of parts so as to realize cost reduction and space saving.

According to an aspect of the present invention is to provide a cartridge detachably mountable to a main assembly of an electrophotographic image forming apparatus having a main assembly electrical contact, the cartridge comprising:

a developer carrying member for developing an electrostatic latent image formed on an image bearing member; and an electroconductive developer layer thickness regulating member for regulating a layer thickness of a developer deposited on the developer carrying member;

wherein a part of the developer layer thickness regulating member is directly contactable to the main assembly electrical contact.

According to another aspect of the present invention is to provide an electrophotographic image forming apparatus for forming an image on a recording material, comprising:

(a) a main assembly electrical contact;

(b) a cartridge detachably mountable to a main assembly of an electrophotographic image forming apparatus having a main assembly electrical contact, the cartridge comprising:

a developer carrying member for developing an electrostatic latent image formed on an image bearing member; and an electroconductive developer layer thickness regulating member for regulating a layer thickness of a developer deposited on the developer carrying member;

wherein a part of the developer layer thickness regulating member is directly contactable to the main assembly electrical contact; and (c) conveying means for conveying the recording material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, with reference to the drawings, embodiments of a cartridge detachably mountable to a main assembly of an electrophotographic image forming apparatus will be described. In the following description, the electrophotographic image forming apparatus to which a developing cartridge is detachably mountable will be described as an example.

However, the present invention is not limited thereto. The cartridge detachably mountable to the main assembly of the electrophotographic image forming apparatus may also be a process cartridge.

Here, the developing cartridge is prepared by integrally supporting a developer carrying member and a developer layer thickness regulating member into a cartridge. Further, the process cartridge is prepared by integrally supporting an image bearing member and a developing means as a process means acting on the image bearing member into a cartridge. These cartridges are detachably mountable to the main assembly of the electrophotographic image forming apparatus by a user.

Further, the electrophotographic image forming apparatus forms an image on a recording material by using an electrophotographic image forming system. Examples of the electrophotographic image forming apparatus may include an electrophotographic copying machine, an electrophotographic printer (an LED printer, a laser beam printer, or the like), a facsimile machine, and a word processor.

The recording material is a material or medium on which the image is to be formed and may include, e.g., paper, a sheet material, and an OHP sheet.

The main assembly of the electrophotographic image forming apparatus is an electrophotographic image forming apparatus portion excluding the cartridge.

First Embodiment (General Structure of Electrophotographic Image Forming Apparatus)

First, with reference to FIGS. 1 and 2, a general structure and an image forming operation of the electrophotographic image forming apparatus will be described.

Figure 1:
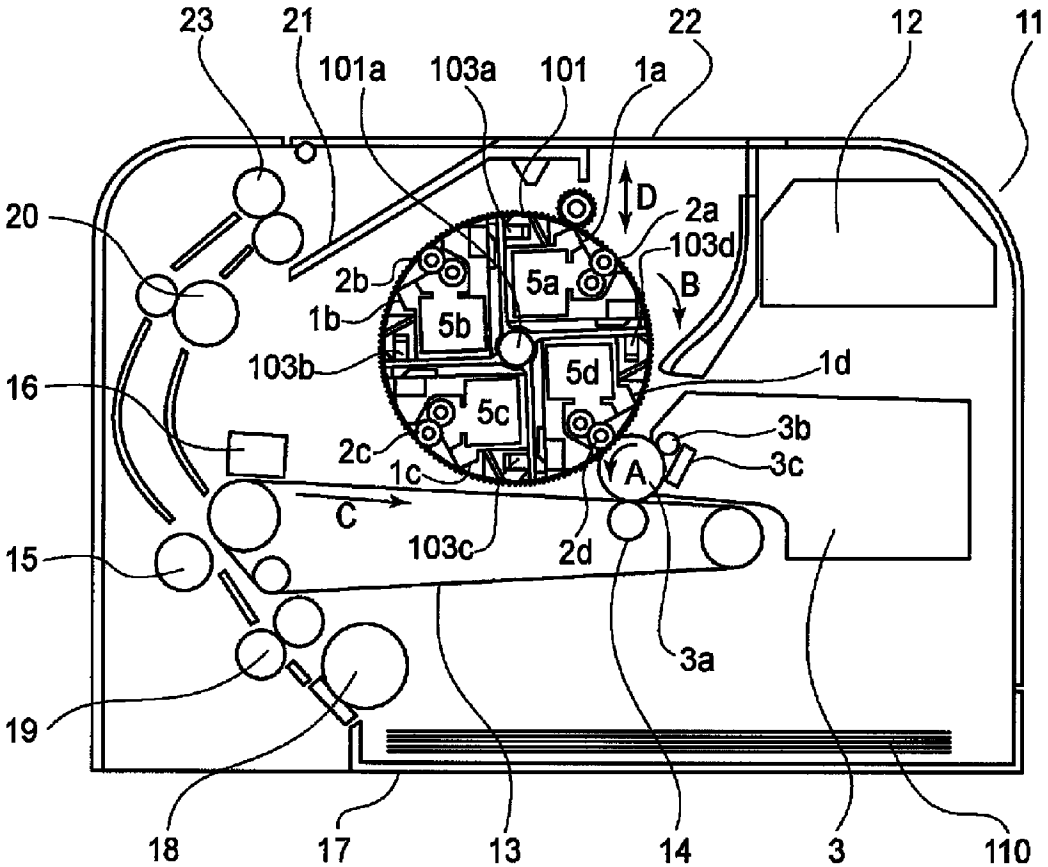
FIGS. 1 and 2 are sectional views each showing an image forming apparatus.
Figure 2:
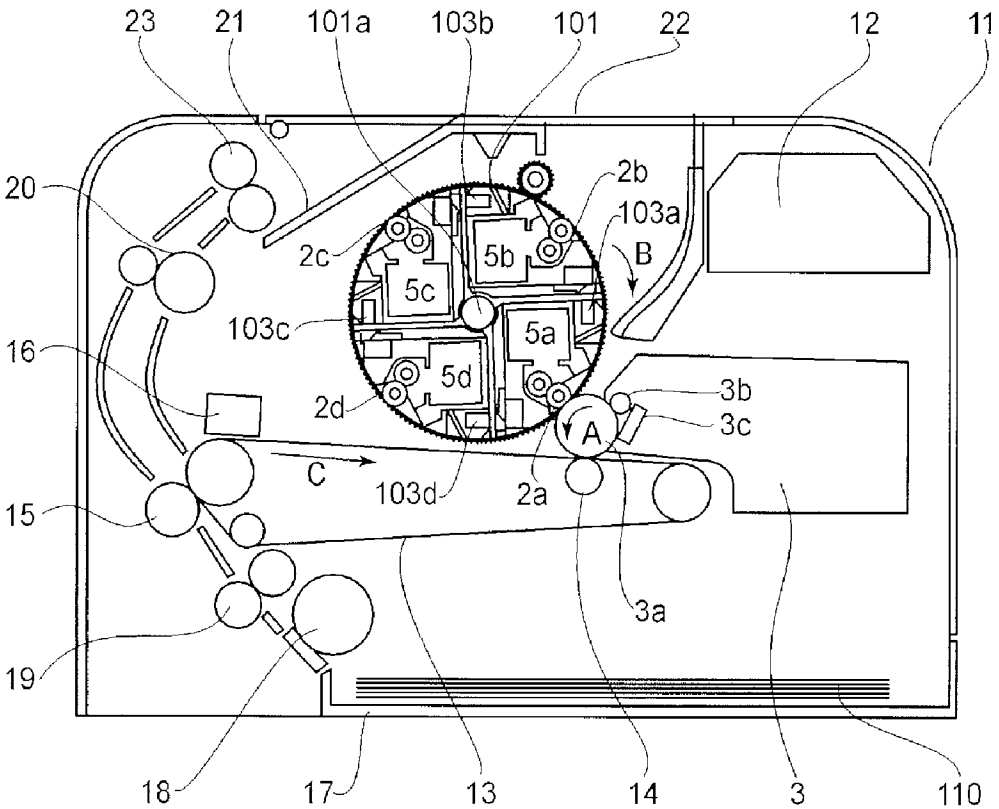

FIG. 1 and FIG. 2 are sectional views each showing an image forming apparatus main assembly 11 of the image forming apparatus and a developing cartridge 5.

The image forming apparatus shown in each of FIG. 1 and FIG. 2 is a four color-based full-color laser beam printer to which four developing cartridges 5 and a single drum cartridge 3 are detachably mountable. In a state in which the drum cartridge 3 and the developing cartridges 5 are mounted in the main assembly 11, an exposure means (a laser scanner unit) 12 is disposed above the drum cartridge 3. Further, below the cartridges 3 and 5, a sheet feeding cassette 17 accommodating the recording material (hereinafter referred to as a sheet) 110 is disposed. In the main assembly 11, along a conveyance direction of the sheet 110, members including a feeding roller 18, a conveying roller 19, a secondary transfer roller 15, a fixing device 20, a sheet discharging roller 23, a sheet discharging portion 21, and the like are disposed. The feeding roller 18, the conveying roller 19, the sheet discharging roller 23, and the like constitute a conveying means for conveying the sheet. An intermediary transfer belt 13 is an intermediary transfer member for temporarily carrying and conveying a developer image formed on an image bearing member (photosensitive drum) 3*a*. A primary transfer roller 14 is a transfer roller for primary-transferring the developer image from the photosensitive drum 3*a* onto the intermediary transfer belt 13. A cleaning unit 16 removes a developer (toner) remaining on the intermediary transfer belt 13 after transfer.

The drum cartridge 3*a* is prepared by integrally supporting the photosensitive drum 3*a*, and a charging means 3*b* and a cleaning means 3*c*, which are process means acting on the photosensitive drum 3*a*, into a cartridge, which is detachably mountable to the main assembly 11. The charging means 3*b* electrically charges the photosensitive drum 3*a* uniformly. The cleaning means 3*c* removes the toner remaining on the photosensitive drum 3*a* after the transfer. Incidentally, it is also possible to employ a constitution in which the photosensitive drum 3*a*, the charging means 3*b* and the cleaning means 3*c* are independently prepared.

Each of the developing cartridges 5 is developing device (developing means) for developing the electrostatic latent image formed on the photosensitive drum 3*a* with associated (color) toner to visualize the electrostatic latent image. In this embodiment, as described above, the four developing cartridges are used and includes a developing cartridge yellow 5*a*, a magenta developing cartridge 5*b*, a cyan developing cartridge 5*a*, and a black developing cartridge 5*d*. The yellow developing cartridge 5*a*, the magenta developing cartridge 5*b*, the cyan developing cartridge 5*c*, and the black developing cartridge 5*d* are held by a rotary 101 rotatably mounted to the main assembly 11. The yellow developing cartridge 5*a*, the magenta developing cartridge 5*b*, the cyan developing cartridge 5*c*, and the black developing cartridge 5*d* are detachably mountable to the rotary 101. As described later specifically, each developing cartridge includes a developing roller (the developer carrying member) 2 for developing the electrostatic latent image formed on the photosensitive drum 3*a* and includes an electroconductive developing blade (the developer layer thickness regulating member) 1 for regulating a layer thickness of the toner to be deposited on the developing roller 2. As shown in FIG. 1, the yellow developing cartridge 5*a* includes the developing roller 2*a* and the developing blade 1*a*. The magenta developing cartridge 5*b* includes the developing roller 2*b* and the developing blade 1*b*. The cyan developing cartridge 5*c* includes the developing roller 2*c* and the developing blade 1*c*. The black developing cartridge 5*d* includes the developing roller 2*d* and the developing blade 1*d*.

The rotary 101 has constitutes for holding the yellow developing cartridge 5*a*, the magenta developing cartridge 5*b*, the cyan developing cartridge 5*c*, and the black developing cartridge 5*d* which are similar to each other. Therefore, in this embodiment, as the constitute for holding the developing cartridge 5 by the rotary 101, that for the yellow developing cartridge 5*a* will be described as an example.

Figure 3:
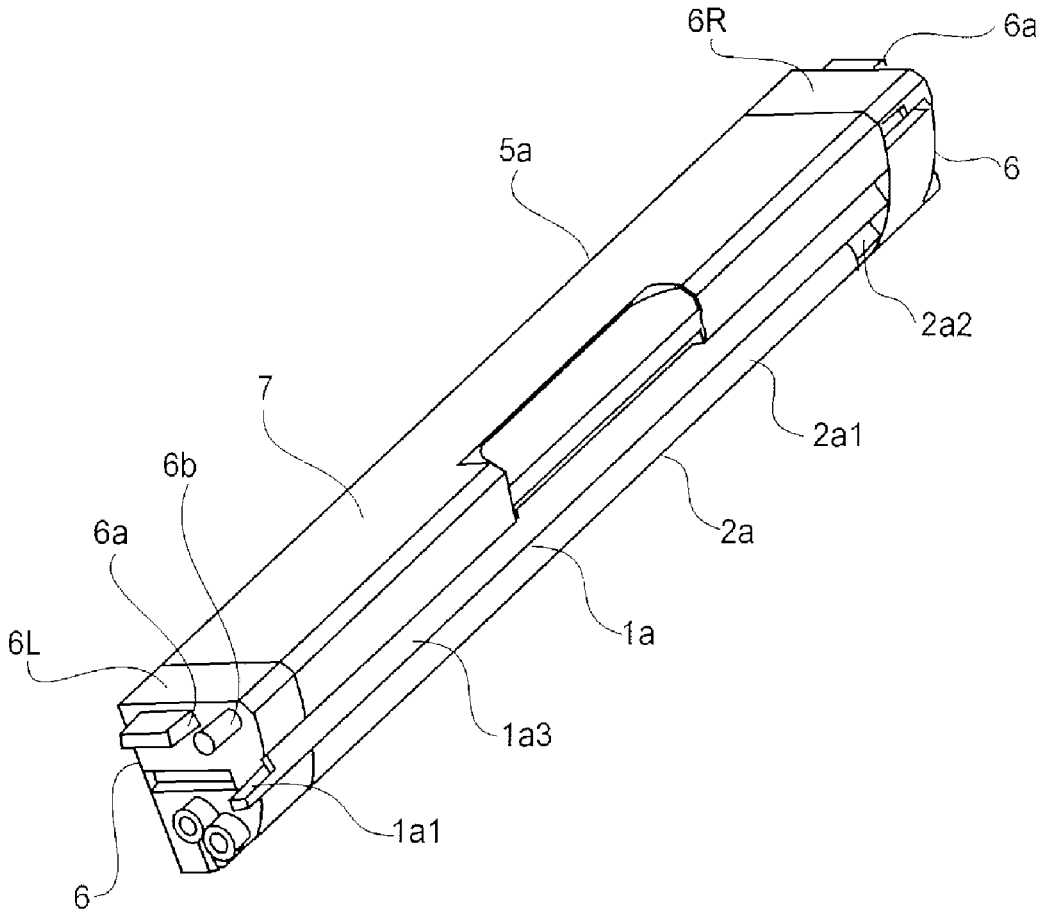
FIG. 3 is a perspective view of an outer appearance of a developing cartridge.

As shown in FIG. 3, the yellow developing cartridge 5*a* includes a portion 6*a* to be locked as a portion to be guided and includes a rotation preventing portion (a portion to be positioned) 6*b* as the portion to be guided. When the yellow developing cartridge 5*a* is mounted to and demounted from the rotary 101, the portions to be guided (the portion 6*a* to be locked and the rotation preventing portion 6*b*) are guided by a guide portion 101*c* provided to the rotary 101. In a state in which the yellow developing cartridge 5*a* is mounted to the rotary 101, the portion 6*a* to be locked is locked by a developing cartridge locking member 103*a* provided to the rotary 101. As a result, disengagement of the yellow developing cartridge 5*a* from the rotary 101 is suppressed. The developing cartridge locking member 103*a* is urged by a spring (not shown) in a direction, of an arrow D indicated in FIG. 1, in which the developing cartridge locking member 103*a* is engageable with the yellow developing cartridge 5*a*. Incidentally, with respect to other developing cartridges 5*b*, 5*c* and 5*d*, the disengagement of the developing cartridges 5*b*, 5*c* and 5*d* from the rotary 101 is suppressed by engaging portions to be locked, provided to the respective developing cartridges 5*b*, 5*c* and 5*d*, with developing cartridge locking members

103*b*, 103*c* and 104*d*, respectively, provided to the rotary 101. In this embodiment, the portion 6*a* to be locked and the rotation preventing portion 6*b* are projected from a frame of the developing cartridge 5*a* with respect to a longitudinal direction of the developing cartridge 5*a*.

First, the photosensitive drum 3*a* is rotated in a direction of an arrow A indicated in FIG. 1. In synchronism with the rotation of the photosensitive drum 3*a*, the intermediary transfer belt 13 is rotated in a direction of an arrow C indicated in FIG. 1. Then, the surface of the photosensitive drum 3*a* is charged uniformly by the charging means 3*b* and at the same time is exposed to light for an yellow image by the exposure means 12, so that an electrostatic latent image for yellow is formed on the photosensitive drum 3*a*.

Simultaneously with the formation of the electrostatic latent image, the rotary which holds the respective developing cartridges 5*a*, 5*b*, 5*c* and 5*d* is rotated about a rotary rotational shaft 101*a* in a direction of an arrow B indicated in FIG. 1 by a drive transmission mechanism provided to the main assembly 11. As a result, the yellow developing cartridge 5*a* is positioned at a developing position in which the yellow developing cartridge 5*a* opposes the photosensitive drum 3*a* (a state shown in FIG. 2).

A potential difference is provided between the photosensitive drum 3*a* and the developing roller 2*a* so that yellow toner is deposited on the latent image formed on the photosensitive drum 3*a*. As a result, the yellow toner is deposited on the latent image formed on the photosensitive drum 3*a* to develop the latent image. That is, a yellow toner image is formed on the photosensitive drum 3*a*.

Thereafter, a voltage of an opposite polarity to the charge polarity of the toner is applied to the primary transfer roller 14 disposed inside the intermediary transfer belt 13 to primary-transfer the yellow toner image from the photosensitive drum 3*a* onto the intermediary transfer belt 13.

In the above-described manner, when the primary transfer of the yellow toner image is completed, the rotary 101 is rotationally moved in the direction of the arrow B indicated in FIG. 2 by being supplied with a driving force from the drive transmission mechanism of the main assembly 11. Thus, the magenta developing cartridge 5*b*, the cyan developing cartridge 5*c*, and the black developing cartridge 5*d* are successively positioned at the developing position in which an associated developing cartridge opposes the photosensitive drum 3*a*. At the developing position, similarly as in the case of yellow, the electrostatic latent image is formed and developed and an associated toner image is primary-transferred with respect to magenta, cyan and black, so that the resultant four color toner images are superposed on the intermediary transfer belt 13.

During these steps, the secondary transfer roller 15 is in a non-contact state with the intermediary transfer belt 13 as shown in FIG. 1. Further, the cleaning unit 16 for the intermediary transfer belt 13 is also in a non-contact state with the intermediary transfer belt 13.

The sheet 110 stacked and accommodated in the feeding cassette 17 is separated one by one and fed toward the conveying roller 19 by the feeding roller 18. The conveying roller 19 sends the fed sheet 110 to a position between the intermediary transfer belt 13 and the secondary transfer roller 15. At this position, as shown in FIG. 2, the secondary transfer roller 15 is in a contact state with the intermediary transfer belt 13.

Further, to the secondary transfer roller 15, a voltage of an opposite polarity to the charge polarity of the toner is applied, so that the four color toner images superposed on the intermediary transfer belt 13 as described above are secondary-transferred onto the surface of the conveyed sheet 110.

The sheet 110 on which the toner images are transferred is sent to the fixing device 20. In the fixing device 20, the sheet 110 is heated and pressed, so that the toner images are fixed on the sheet 110. As a result, an image is formed on the sheet 110. Thereafter, the sheet 110 is discharged onto the sheet discharge portion 21 outside the main assembly 11 by the sheet discharging roller 23.

(Developing Cartridge)

The yellow developing cartridge 5*a*, the magenta developing cartridge 5*b*, the cyan developing cartridge 5*c*, and the developing cartridge black developing cartridge 5*d* have the same constitution. Therefore, the constitution of the developing cartridge will be described by taking the yellow developing cartridge 5*a* as an example. Hereinbelow, the constitution of the developing cartridge will be described with reference to FIGS. 4(*a*) and 4(*b*) and FIGS. 5(*a*), 5(*b*) and 5(*c*).

Figure 4:
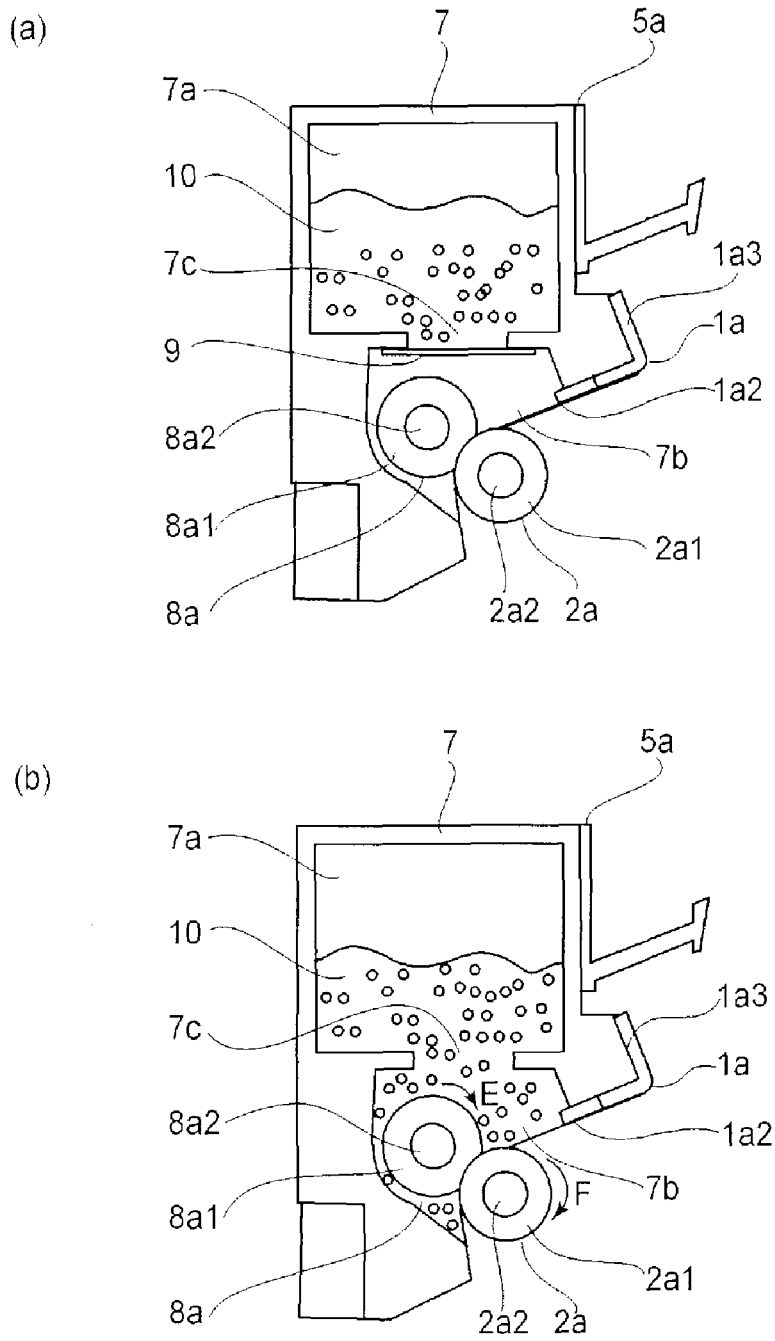
FIGS. 4(*a*) and 4(*b*) are sectional views each showing a schematic structure of the developing cartridge.
Figure 5:
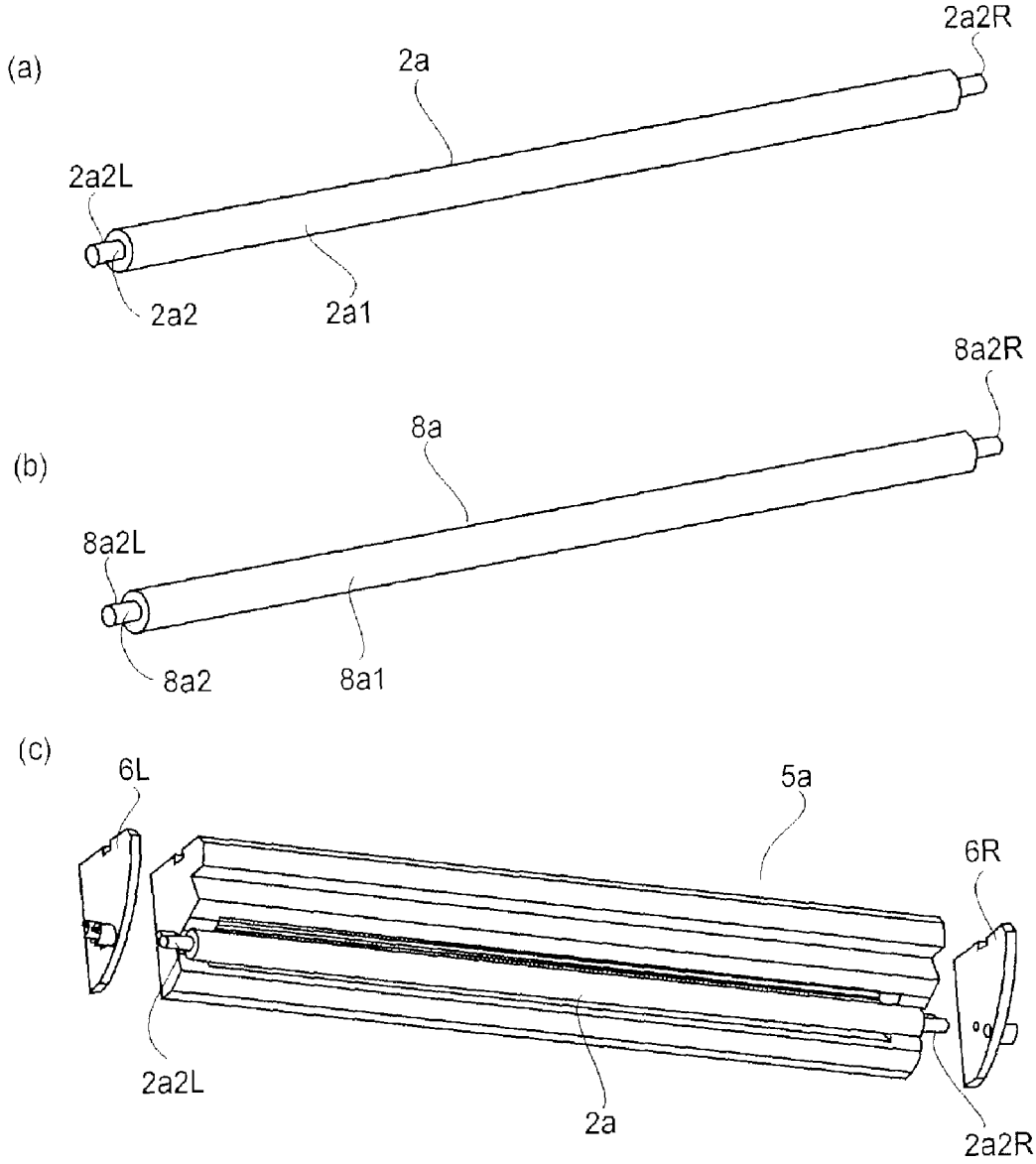
FIG. 5(*a*) is a perspective view of a developing roller, FIG. 5(*b*) is a perspective view of a toner supplying roller, and FIG. 5(*c*) is a perspective view of the developing cartridge for illustrating a roller supporting structure.

FIGS. 4(*a*) and 4(*b*) are sectional views showing the yellow developing cartridge 5*a*, FIG. 5(*a*) is a perspective view of the developing roller, FIG. 5(*b*) is a perspective view of a toner supplying roller, and FIG. 5(*c*) is a perspective view of the yellow developing cartridge for illustrating a roller supporting constitution.

A developing container 7 as a frame for the yellow developing cartridge 5*a* is vertically separated into a toner accommodating chamber 7*a* and a developing chamber 7*b* which includes the developing roller 2*a* and the toner supplying roller 8*a* by a toner supply opening 7*c*. The developer container 7 also includes side members 6L and 6R. In an unused state until the yellow developing cartridge 5*a* is delivered to the user, as shown in FIG. 4(*a*), at the toner supply opening 7*c*, a film-like toner seal 9 for separating the toner accommodating chamber 7*a* and the developing chamber 7*b* from each other is fixed to the developing container 7 by a method such as welding.

By removing the toner seal 9 before use, toner 10 in the toner accommodating chamber 7*a* falls freely in the developing chamber 7*b* as shown in FIG. 4(*b*) at a position in which the yellow developing cartridge 5*a* opposes the photosensitive drum 3*a* as shown in FIG. 2.

The developing roller 2*a* is, as shown in FIG. 4(*a*), constituted by a rubber roller portion 2*a*1 and a rigid shaft 2*a*2. The rigid shaft 2*a*2 penetrates through the rubber roller portion 2*a*1 in a rotational axis direction the developing roller 2*a* and forms, as shown in FIG. 5(*a*), projected portions 2*a*2L and 2*a*2R projected from the rubber roller portion 2*a*1 at both end portions thereof.

The toner supplying roller 8*a* is, as shown in FIG. 4(*a*), constituted by a sponge roller portion 8*a*1 and a rigid shaft 8*a*2. The rigid shaft 8*a*2 penetrates through the sponge roller portion 8*a*1 in a rotational axis direction toner supplying roller 8*a* and forms, as shown in FIG. 5(*b*), projected portions 8*a*2L and 8*a*2R projected from the sponge roller portion 8*a*1 at both end portions thereof.

The supporting constitution of the toner supplying roller 8*a* by the yellow developing cartridge 5*a* is similar to that of the developing roller 2*a* by the yellow developing cartridge 5*a*. Therefore, the roller supporting constitution by developing cartridge will be described by taking the supporting constitution of the developing roller 2*a* by the yellow developing cartridge 5*a* as an example. The yellow developing cartridge 5*a*, as shown in FIG. 5(*c*), rotatably holds the developing roller 2*a* by the side members 6L and 6R which hold the projected portions 2*a*2L and 2*a*2R, respectively, of the developing roller 2*a*.

The toner 10 in the developing chamber 7*b* is fed to the toner supply roller 8*a*, which is rotated in a direction of an arrow E indicated in FIG. 4(*b*) to feed the toner 10 to the developing roller 2*a*. The developing roller 2*a* is rotated in a direction of an arrow F indicated in FIG. 4(*b*) and then the toner 10 on the developing roller 2*a* is regulated by the developing blade 1*a* to be subjected to development on the photosensitive drum 3*a*. After the development, the toner 10 remaining on the developing roller 2*a* is removed by the toner supplying roller 8*a*. Thereafter, the toner 10 is supplied again to the developing roller 2*a* by the toner supplying roller 8*a*. The developing roller 2*a* is supplied with a voltage from the main assembly 11 so as to provide a potential difference between the developing roller 2*a* and the photosensitive drum 3*a*. The toner supplying roller 8*a* is also supplied with a voltage from the main assembly 11.

At the developing position, in order to stably bring the developing roller 2*a* into contact with the photosensitive drum 3*a*, the rotary 101 by which the yellow developing cartridge 5*a* is held is urged toward the photosensitive drum 3*a*. As a result, the developing roller 2*a* of the yellow developing cartridge 5*a* is placed in a state in which the developing roller 2*a* contacts the photosensitive drum 3*a* at a predetermined urging force.

(Mounting and Demounting Method of Developing Cartridge with Respect to Image Forming Apparatus Main Assembly)

Next, with reference to FIGS. 6 to 8, a mounting and demounting operation of the yellow developing cartridge 5*a*, the magenta developing cartridge 5*b*, the cyan developing cartridge 5*c*, and the black developing cartridge 5*d* with respect to the image forming apparatus main assembly 11 will be described.

Figure 6:
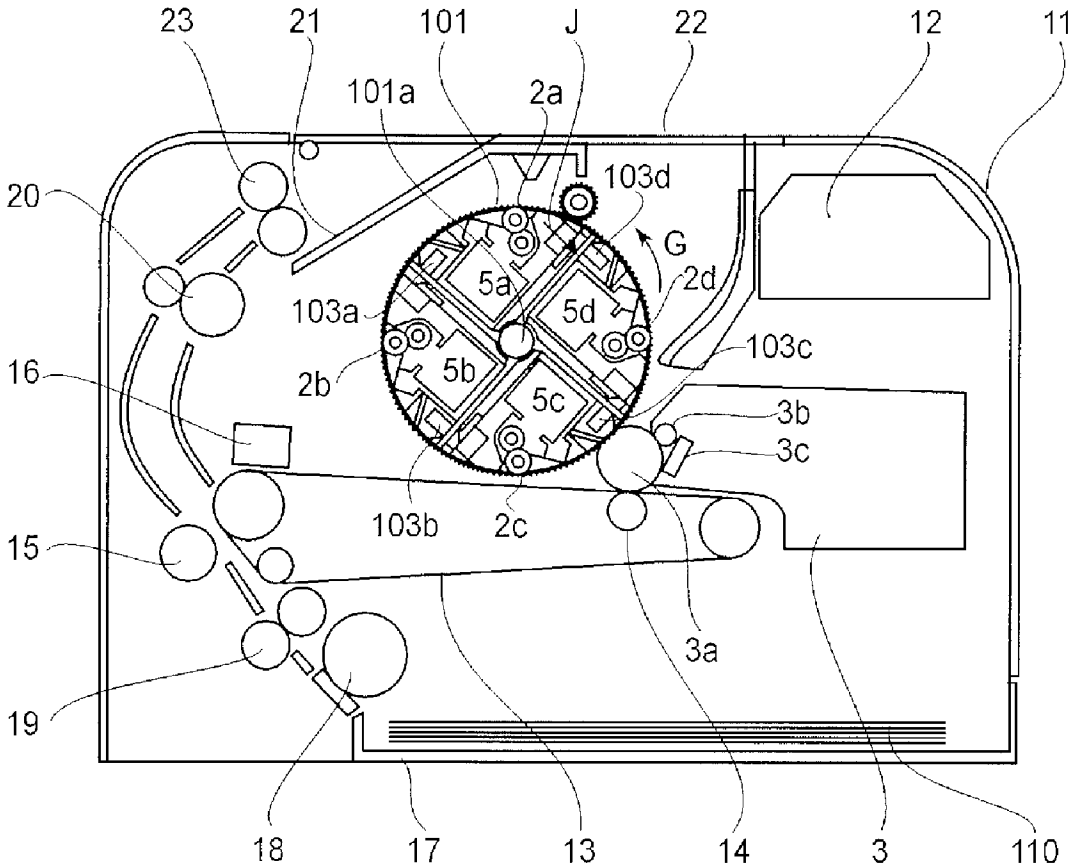
FIGS. 6, 7 and 8 are sectional views each showing a mounting and demounting position of the developing cartridge.

The rotary 101 is, as shown in FIG. 6, on standby in a period other than during the developing operation at a position in which the developing roller 2*a* is rotated about the rotary rotational shaft 101*a* to a phase at which the developing roller 2*a* is moved away from the photosensitive drum 3*a*. In this case, a stand-by position of the black developing cartridge 5*d* is a position rotated by 45 degrees from the developing position in a direction of an arrow G indicated in FIG. 6. Movement of each developing cartridge to an associated stand-by position is automatically performed by the drive transmission mechanism after completion of the image forming operation. The stand-by position of the black developing cartridge 5*d* shown in FIG. 6 is used as a mounting and demounting position of the developing cartridge.

Figure 7:
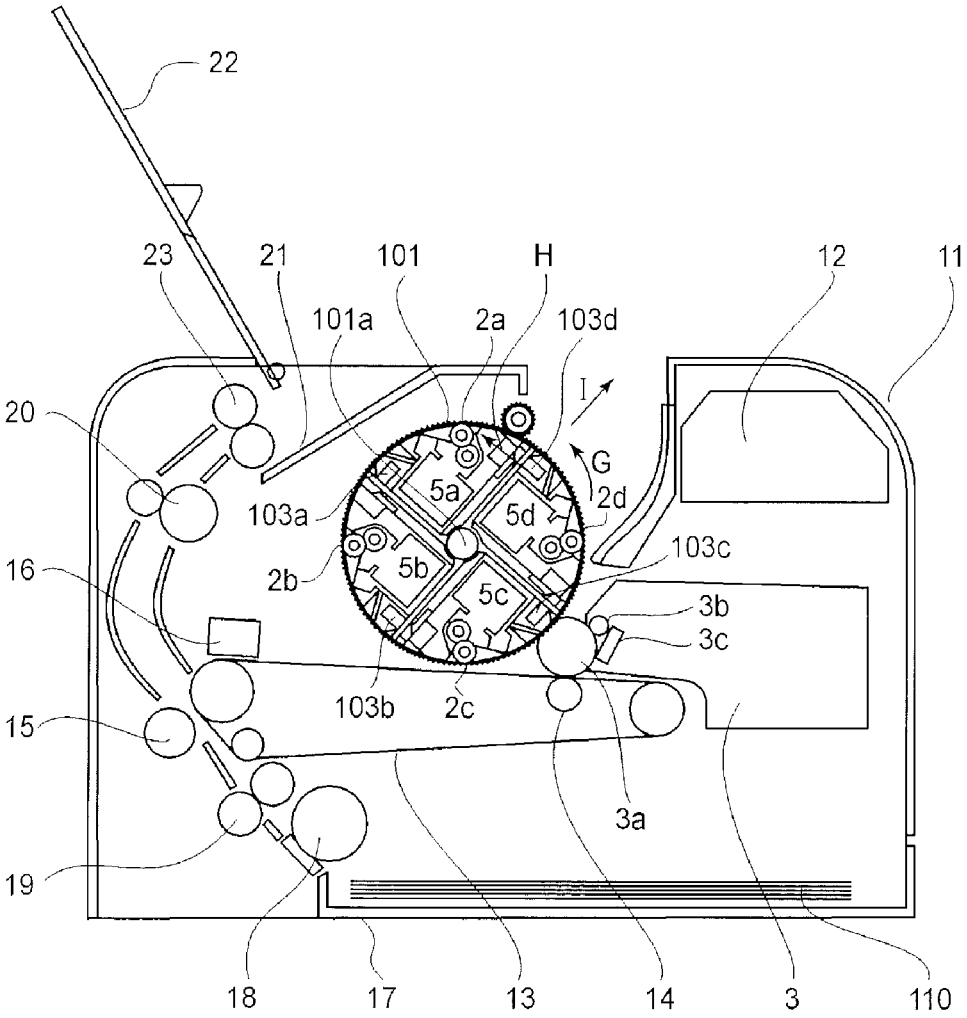
Figure 8:
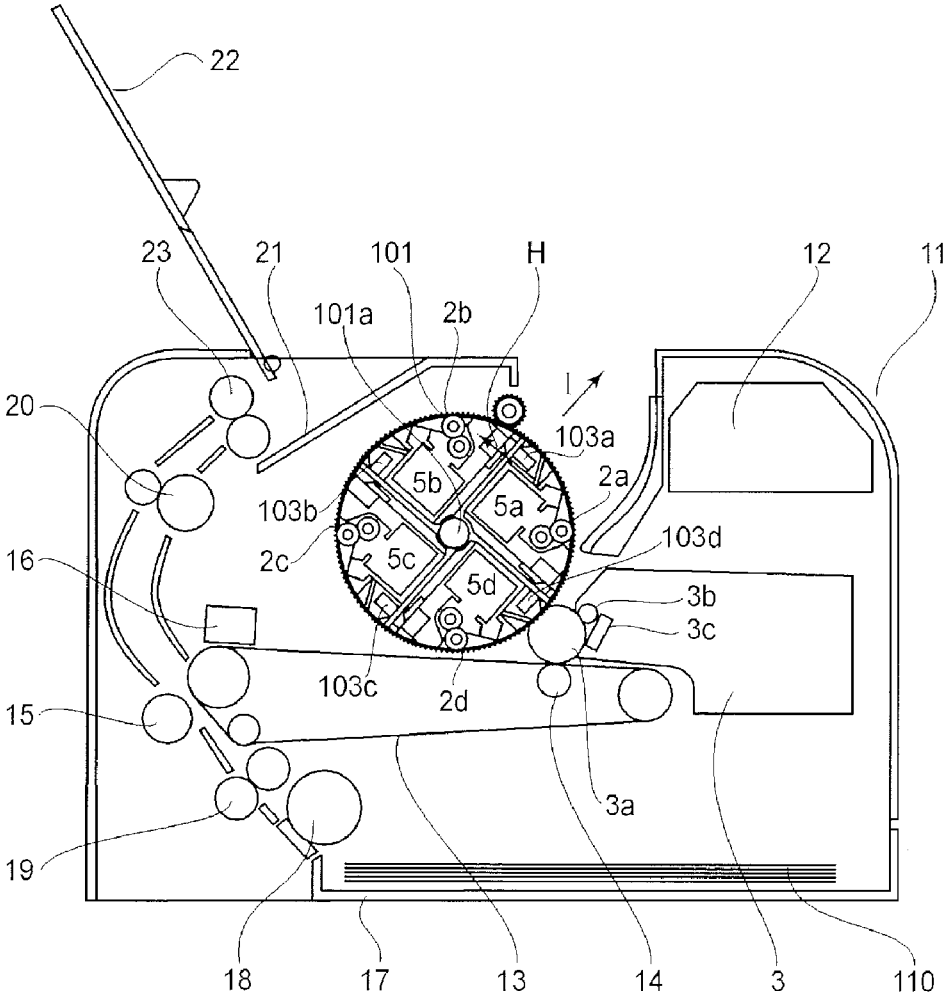

At the mounting and demounting position, as shown in FIG. 7, the developing cartridge locking member 103*d* is retracted in a direction of an arrow H indicated in FIG. 7 by opening a mounting and demounting cover 22 to disengage the portion 6*d* to be looked of the black developing cartridge 6*d*. As a result, the black developing cartridge 5*d* can be mounted to and demounted from the rotary 101 with respect to a direction of an arrow I, as a mounting and demounting direction, indicated in FIG. 7.

The mounting and demounting operation for the yellow developing cartridge 5*a*, the magenta developing cartridge 5*b*, and the cyan developing cartridge 5*c* is also similarly performed. The mounting and demounting operation of the developing cartridge will be described more specifically by taking that of the yellow developing cartridge 5*a* as an example.

The mounting and demounting of the yellow developing cartridge 5*a* can be performed only at the above-described mounting and demounting position. Movement of the yellow developing cartridge 5*a* to the mounting and demounting position can be performed by the drive transmission mechanism or by directly moving the rotary 101 manually. When the yellow developing cartridge 5*a* is moved to the mounting and demounting position, as shown in FIG. 8, the portion 6*a* to be locked of the yellow developing cartridge 5*a* is disengaged by retracting the developing cartridge locking member 103*a* in the direction of the arrow H indicated in FIG. 8 through the opening of the mounting and demounting cover 22. As a result, the yellow developing cartridge 5*a* can be mounted to and demounted from the rotary 101 in the direction of the arrow I, as the mounting and demounting direction, indicated in FIG. 8.

When the user closers the mounting and demounting cover 22, as shown in FIG. 6, the locking member 103*a* is moved in a direction of an arrow J indicated in FIG. 6 to be engaged with the portion 6*a* to be locked of the yellow developing cartridge 5*a*. As a result, disengagement of the yellow developing cartridge 5*a* from the rotary 101 is suppressed.

(Developing Blade Supporting Constitution in Developing Cartridge)

Figure 9:
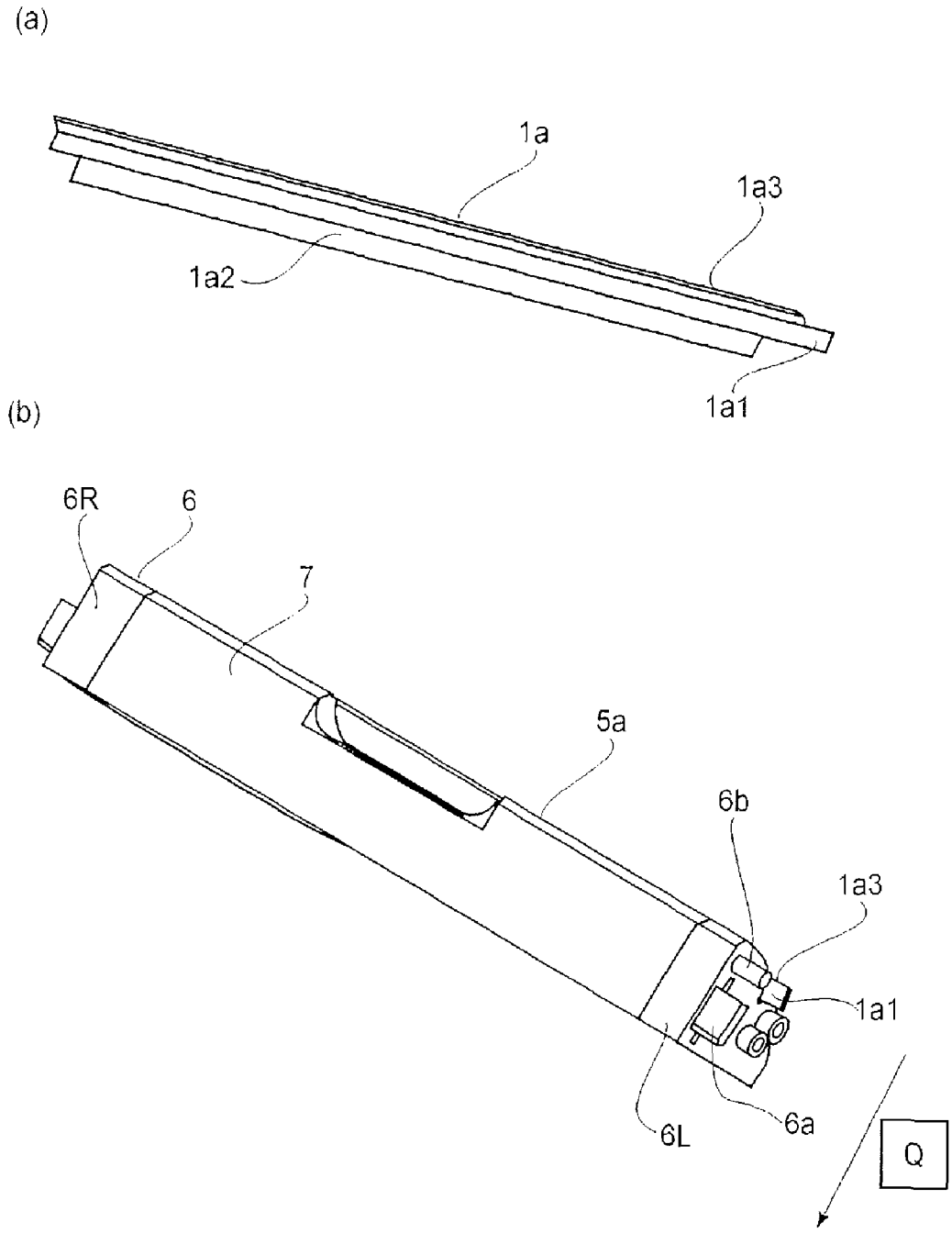
FIG. 9(*a*) is a perspective view of a developing blade and FIG. 9(*b*) is a perspective view of an outer appearance of the developing cartridge.

Next, with reference to FIGS. 4(*a*) and 4(*b*) and FIGS. 9(*a*) and 9(*b*), the developing blade supporting constitution in the developing cartridge will be described. FIG. 9(*a*) is a perspective view of the developing blade and FIG. 9(*b*) is a perspective view of an outer appearance of the developing cartridge.

The developing blade 1*a* is, as shown in FIGS. 4(*a*) and 5(*b*) and FIG. 9(*a*), constituted by a layer thickness regulating member 1*a*2 and a holding member 1*a*3 and the layer thickness regulating member 1*a*2 is bonded to the holding member 1*a*3. In this case, these members 1*a*2 and 1*a*3 are bonded by using YAG welding but another boding method may also be employed.

As shown in FIGS. 4(*a*) and 4(*b*), the developing blade 1*a* is fixed to the developing container 7 at a portion of the holding member 1*a*3 so that the layer thickness regulating member 1*a*2 contacts the developing roller 2*a*.

Figure 12:
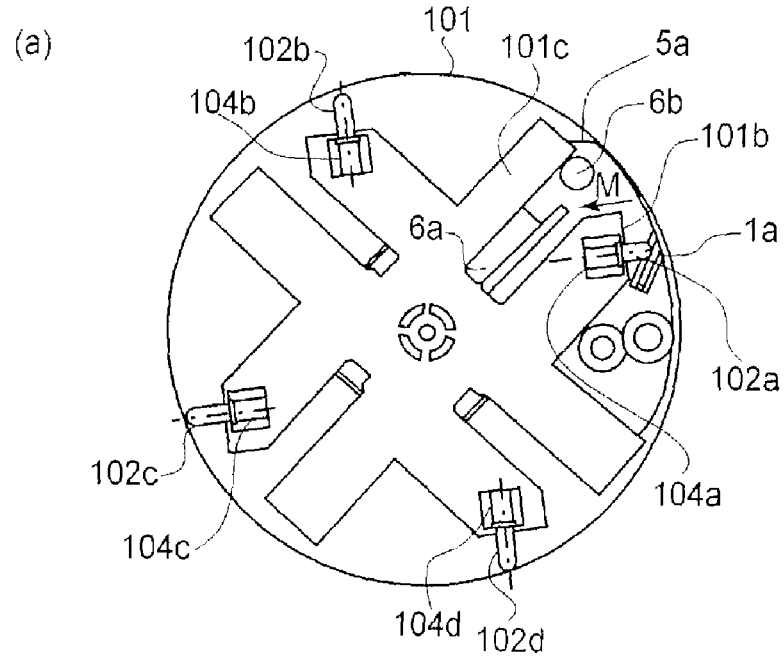
FIGS. 12(*a*) and 12(*b*) are sectional views each showing a relationship between the main assembly electrical contacts and the developing blade after the developing cartridge is mounted.
Figure 12:
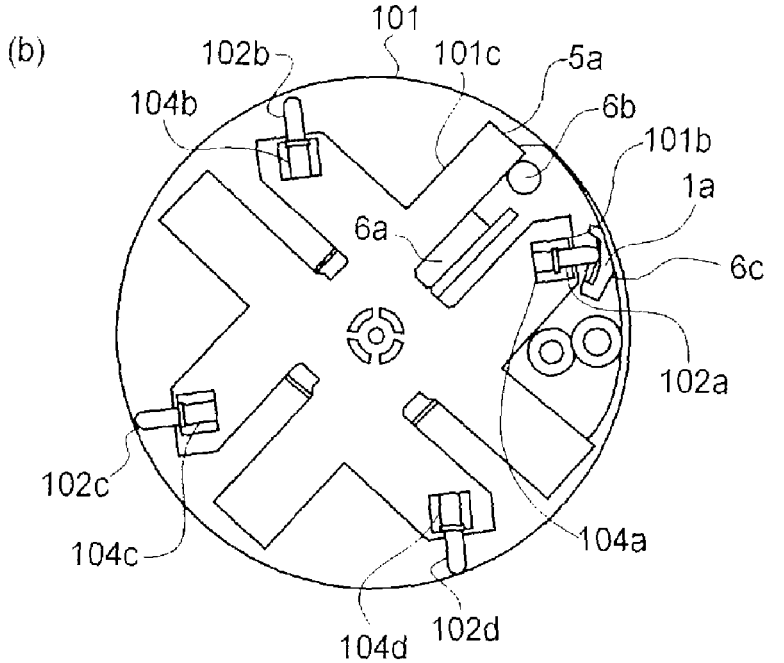

The developing blade 1*a* is exposed from the developing cartridge 5 so that a part thereof directly contacts a main assembly electrical contact 102*a* (FIGS. 12(*a*) and 12(*b*)) provided to the main assembly 11. In this case, as shown in FIG. 9(*a*), a developing blade contact surface 1*a*1 which is a contact portion with the main assembly electrical contact 102*a* is provided to a part of the holding member 1*a*3 of the developing blade 1*a*. This developing blade contact surface 1*a*1 is projected from an outer appearance shape (longitudinal end portion) of the developing cartridge 5*a*. In this case, as shown in FIG. 9(*b*), the developing blade contact surface 1*a*1 is projected from the side member 6L (a frame end portion) of the yellow developing cartridge 5*a* with respect to the longitudinal direction of the developing blade 1*a*. Incidentally, the magenta developing cartridge 5*b*, the cyan developing cartridge 5*c*, and the black developing cartridge 5*d* are also constituted similarly. The contact surface 1*a*1 is disposed oppositely to the projected portions (the portion 6*a* to be locked and the rotation preventing portion 6*b*) projected from the frame end portion of the cartridge 5*a*. As a result, the contact surface 1*a*1 is prevented from being touched by the user. The above constitution is particularly effective to prevent the contact surface 1*a*1 from being touched by the user when an electroconductive agent (an electroconductive grease or the like) is applied onto the contact surface 1*a*1. Further, the contact surface 1*a*1 is directed downwardly (in a direction of an arrow Q indicated in FIG. 9(*b*)) in the case where the cartridge 5*a* is mounted outside the main assembly. Also by this constitution, it is possible to suppress the touch of the contact surface 1*a*1 by the user.

(Constitution for Applying Voltage from Image Forming Apparatus Main Assembly to Developing Blade)

Next, with reference to FIGS. 1, 2 and 10 to 12(*b*), a constitution for applying a voltage from the image forming apparatus main assembly to the developing blade 1 of each developing cartridge 5 will be described. The same constitution for applying the voltage from the main assembly to the developing blade of the developing cartridge is employed with respect to the developing blades 1*a*, 1*b*, 1*c* and 1*d*. Therefore, description will be made by taking the constitution for applying the voltage from the main assembly to the yellow developing cartridge 5*a* as an example.

Figure 10:
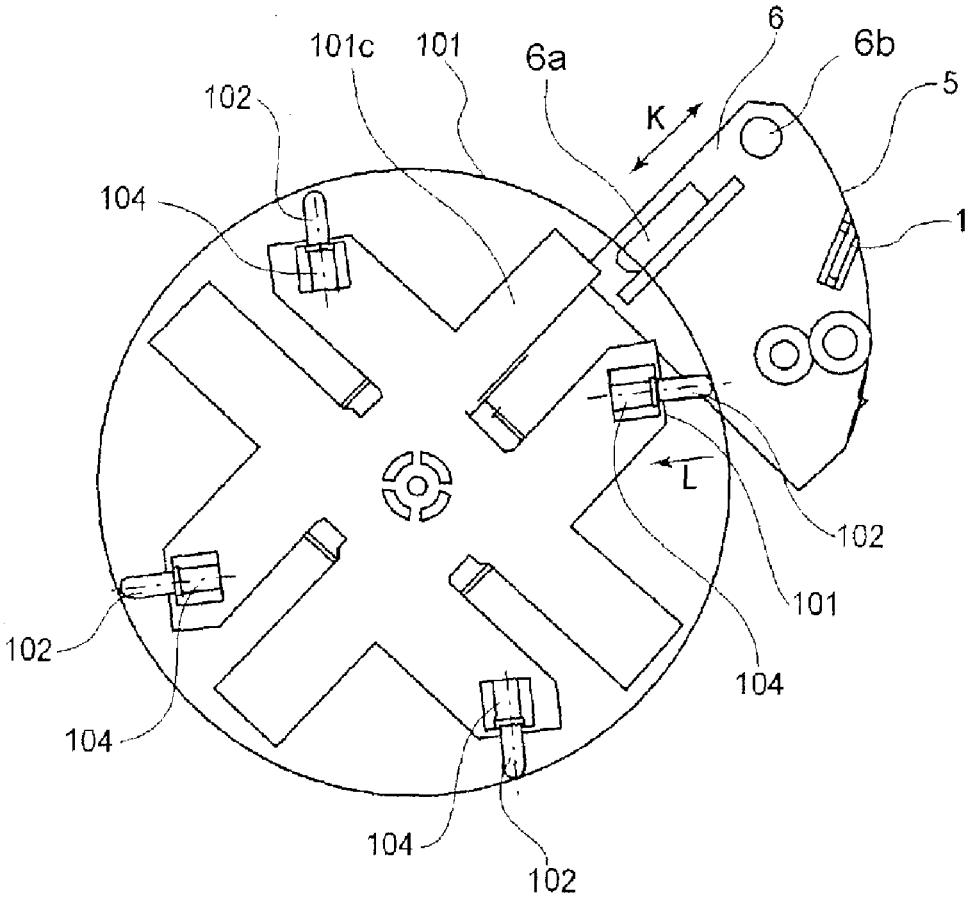
FIG. 10 is a sectional view showing a relationship between main assembly electrical contacts and the developing blade before the developing cartridge is mounted.
Figure 11:
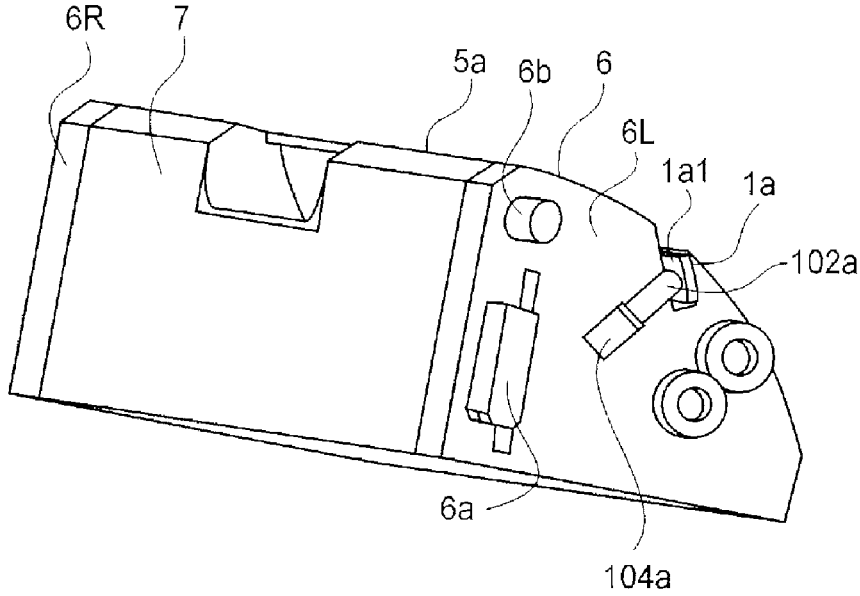
FIGS. 11(*a*) and 11(*b*) are perspective views each showing a state in which the main assembly electrical contact contacts a developing blade contact surface of the developing blade.
Figure 11:
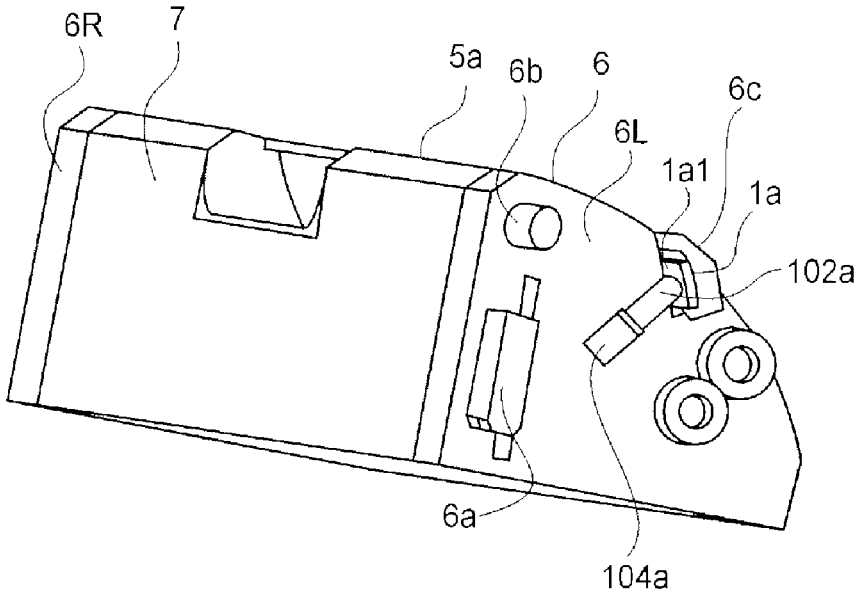

FIG. 10 is a sectional view showing a positional relationship between the main assembly electrical contact and the developing blade before mounting of the cartridge. FIGS. 11(*a*) and 11(*b*) are perspective views each showing a state in which the main assembly electrical contact contacts the developing blade contact surface of the developing blade. FIGS. 12(*a*) and 12(*b*) are sectional views each showing a positional relationship between the main assembly electrical contact and the developing blade after the mounting of the cartridge.

As shown in FIG. 10, the main assembly electrical contact 102*a* is provided to the rotary 101 of the main assembly 11. The main assembly electrical contact 102*a* provided to the rotary 101 is constituted by an urging spring 104*a* and a disengagement preventing portion 101*b* provided to the rotary 101. The main assembly electrical contact 102*a* is urged by an urging spring 104*a* in a direction of an arrow L, indicated in FIG. 10, crossing the developing blade contact surface 1*a*1 and is capable of being retracted in a direction of an arrow M, indicated in FIG. 12(*a*), crossing the developing blade contact surface 1*a*1. Therefore, as shown in FIG. 10, the main assembly electrical contact 102*a* placed in a non-contact state with the developing blade contact surface 1*a*1 is urged in the direction of the arrow L by the urging spring 104*a* and is regulated by the disengagement preventing portion 101*b*. Incidentally, in FIG. 10, main assembly electrical contacts 102*b*, 102*c* and 102*d* are provided correspondingly to developing blades of other developing cartridges 5*b*, 5*c* and 5*d*, respectively, and are configured similarly as in the case of the main assembly electrical contact 102*a*.

Further, as shown in FIGS. 11(*a*) and 11(*b*), the developing blade contact surface 1*a*1 is provided so as to be projected from the side member 6L of the yellow developing cartridge 5*a* at an end of the developing roller 2*a* with respect to the rotational axis direction of the developing roller 2*a*. The developing blade contact surface 1*a*1 constituted a surface crossing a direction of an arrow M, indicated in FIG. 10, which is the mounting direction of the cartridge to the main assembly, so that the main assembly electrical contact 102*a* is contactable to the crossing surface (contact surface) 1*a*1.

As shown in FIGS. 12(*a*) and 12(*b*), when the yellow developing cartridge 5*a* is mounted to the rotary 101 of the main assembly, the developing blade contact surface 1*a*1 which is a part of the developing blade projected from the other appearance shape of the yellow developing cartridge 5*a* directly contacts the main assembly electrical contact 102*a*. At this time, the main assembly electrical contact 102*a* urged by the urging spring 104*a* in the direction of the arrow L indicated in FIG. 10 is pressed by the developing blade contact surface 1*a*1 to be retracted into the direction of the arrow M indicated in FIG. 12(*a*). As a result, the main assembly electrical contact 102*a* provided to the main assembly 102*a* and the developing blade contact surface 1*a*1 as the part of the developing blade of the yellow developing cartridge 5*a* contact each other with reliability, so that it is possible to supply a voltage from the main assembly to the developing cartridge.

Further, in this embodiment, the main assembly electrical contact 102*a* is plated with chromiun and the developing blade contact surface 1*a*1 is plated with zinc. However, it is also possible to plate the main assembly electrical contact 102*a* with zinc and plate the developing blade contact surface 1*a*1 with chromium. That is, one of the main assembly electrical contact 102*a* and the developing blade contact surface 1*a*1 may be plated with chromium and the other portion may be plated with zinc. As a result, it is possible to realize stabilization of voltage supply.

As described above, in this embodiment, the main assembly electrical contact 102*a* provided to the main assembly 11 and the part of the developing blade 1 of the developing cartridge 5 directly contact each other. As a result, the voltage is directly supplied from the main assembly electrical contact 102*a* to the developing blade 1 of the developing cartridge 5 without using a contact member extending between the main assembly electrical contact and the developing blade. Therefore, the constitution for electrically connecting the main assembly and the cartridge with each other can be simplified by reducing the number of parts, thus realizing cost reduction and space saving.

Second Embodiment

FIG. 11(*b*) and FIG. 12(*b*) illustrate Second Embodiment. In this embodiment, a part of the side member 6 is different from that in First Embodiment. That is, an end portion (a part) of the developing blade 1 with respect to the longitudinal direction of the developing blade 1 is covered with a covering portion 6*c*. More specifically, the covering portion 6*c* covers the rear surface of the contact surface 1*a*1 and rear surface edge portions of the contact surface 1*a*1 but exposes the front surface of the contact surface 1*a*1 toward the main assembly electrical contact 102*a*. As a result, it is possible to further effectively prevent the contact surface 1*a*1 from being touched by the user.

In the above-described embodiments, the developing cartridge 5 including the developing roller and the developing blade is described as the example of the cartridge detachably mountable to the image forming apparatus main assembly but the cartridge in the present invention is not limited thereto. For example, it is also possible to employ a process cartridge including at least the image bearing member (the photosensitive drum) and the developing means (including the developing roller and the developing blade) as the process means acting on the image bearing member. When the voltage is supplied from the main assembly electrical contact provided to the main assembly to the developing blade of the process cartridge, similarly as in the above-described embodiments, a part (an end portion) of the developing blade is projected from the outer appearance shape of the process cartridge. As a result, the voltage can be directly supplied without using a contact member extending between the main assembly electrical contact and the developing blade. Also by this constitution, similarly as in the above-described embodiments, the constitution for electrically connecting the main assembly with the cartridge can be simplified by reducing the number of parts, so that cost reduction and space saving can be realized.

Further, in the embodiments described above, the four developing cartridges are used but the number of the developing cartridges used is not limited thereto and may also be set appropriately as desired. Further, also in the case of the process cartridges, the number of the process cartridges may be appropriately set as desired.

Further, in the above-described embodiments, the printer is described as the example of the electrophotographic image forming apparatus but the present invention is not limited thereto. The electrophotographic image forming apparatus may also be other image forming apparatuses such as a copying machine, a facsimile machine, and a multi-function machine having functions of these machines. Further, the electrophotographic image forming apparatus is also not limited to such an image forming apparatus that respective color toner images are successively transferred onto the intermediary transfer member in the superposition manner and then are collectively transferred from the intermediary transfer member onto the recording material. For example, it is also possible to use such an image forming apparatus that respective color toner images are successively transferred in the superposition manner onto the recording material carried on a recording material carrying member. By applying the present invention to a cartridge detachably mountable to these image forming apparatuses, the effect of the present invention can be similarly achieved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 223044/2008 filed Sep. 1, 2008 and 181143/2009 filed Aug. 4, 2009, which is hereby incorporated by reference.

What is claimed is:

1. A cartridge comprising:

a frame;

a developer carrying member, rotatably mounted in said frame, for carrying a developer; and an electroconductive developer layer thickness regulating member, mounted in said frame, for regulating a layer thickness of a developer deposited on said developer carrying member, wherein a longitudinal end of said developer layer thickness regulating member is projected outwardly of said frame with respect to a longitudinal direction of said developer layer thickness regulating member, and wherein said longitudinal end of said developer layer thickness regulating member includes a contact portion plated with zinc.

2. A cartridge according to claim 1, further comprising a covering portion for covering a part of said longitudinal end of said developer layer thickness regulating member in a state in which said contact portion is exposed.

3. A cartridge according to claim 2, wherein said covering portion is projected from said frame with respect to the longitudinal direction of said developer layer thickness regulating member.

4. A cartridge according to claim 3, further comprising a projected portion projected from said frame with respect to the longitudinal direction of said developer layer thickness regulating member, wherein said contact portion is disposed oppositely to said projected portion.

5. A cartridge according to claim 4, further comprising a bearing member, provided at an end of said frame with respect to the longitudinal direction of said developer layer thickness regulating member, for rotatably supporting a shaft of said developer carrying member, wherein said bearing member provides said covering portion and said projected portion.

6. An electrophotographic image forming apparatus for forming an image on a recording material, said apparatus comprising:

(a) a main assembly electrical contact; and (b) a cartridge detachably mountable to a main assembly of an said electrophotographic image forming apparatus having said main assembly electrical contact, said cartridge comprising:

a frame;

a developer carrying member, rotatably mounted in said frame, for carrying a developer; and an electroconductive developer layer thickness regulating member, mounted in said frame, for regulating a layer thickness of a developer deposited on said developer carrying member, wherein a longitudinal end of said developer layer thickness regulating member is projected outwardly of said frame with respect to a longitudinal direction of said developer layer thickness regulating member, wherein said developer layer thickness regulating member includes a contact portion that is directly contactable to said main assembly electrical contact, and wherein said main assembly electrical contact is plated with chromium and said contact portion is plated with zinc.

7. An apparatus according to claim 6, wherein said cartridge comprises a covering portion for covering a part of said longitudinal end of said developer layer thickness regulating member in a state in which said contact portion is exposed.

8. An apparatus according to claim 7, wherein said covering portion is projected from said frame with respect to the longitudinal direction of said developer layer thickness regulating member.

9. An apparatus according to claim 8, wherein said cartridge comprises a projected portion projected from said frame with respect to the longitudinal direction of said developer layer thickness regulating member, wherein said contact portion is disposed oppositely to said projected portion.

10. An apparatus according to claim 9, further comprising a bearing member, provided at an end of said frame with respect to the longitudinal direction of said developer layer thickness regulating member, for rotatably supporting a shaft of said developer carrying member, wherein said bearing member provides said covering portion and said projected portion.

* * * * *